United States Patent [19]

Schulte et al.

[11] 4,204,912

[45] May 27, 1980

[54] METHOD AND APPARATUS FOR PURIFYING GASES LEAKING FROM COKE OVENS

[75] Inventors: Fritz Schulte, Meerbusch-Büderich; Wilfried Hürter, Essen, both of Fed. Rep. of Germany

[73] Assignee: Hartung, Kuhn & Co. Maschinenfabrik GmbH, Dusseldorf, Fed. Rep. of Germany

[21] Appl. No.: 958,667

[22] Filed: Nov. 8, 1978

[30] Foreign Application Priority Data

Nov. 9, 1977 [DE] Fed. Rep. of Germany ..... 2750139

[51] Int. Cl.[2] ..... C10B 27/00

[52] U.S. Cl. ..... 201/29; 202/255; 202/263; 55/84

[58] Field of Search ..... 201/30, 29; 202/254, 202/248, 255, 256, 259, 260, 261, 263; 55/70, 83, 84, 263

[56] References Cited

U.S. PATENT DOCUMENTS

| | | | |
|---|---|---|---|
| 1,826,561 | 10/1931 | Miller | 55/70 |
| 3,020,138 | 2/1962 | Wethly | 55/70 |
| 3,764,482 | 10/1973 | Yoshida et al. | 202/263 |
| 3,926,740 | 12/1975 | Krikau | 202/254 |
| 3,933,595 | 1/1976 | Gordon et al. | 202/263 |

*Primary Examiner*—Norman Yudkoff

*Attorney, Agent, or Firm*—Dressler, Goldsmith, Clement, Gordon & Shore, Ltd.

[57] ABSTRACT

A method and apparatus is provided for separating tar from gases leaking from the oven door of a coke oven. At least one gas extraction device is located at a point of leakage and is connected through a collection duct to an extractor fan for sucking the gases from the door. A means is provided for spraying hot ammonia liquor into the upstream portion of the collection duct and a means is provided for introducing saturated steam into the duct downstream of the ammonia spraying means.

8 Claims, 1 Drawing Figure

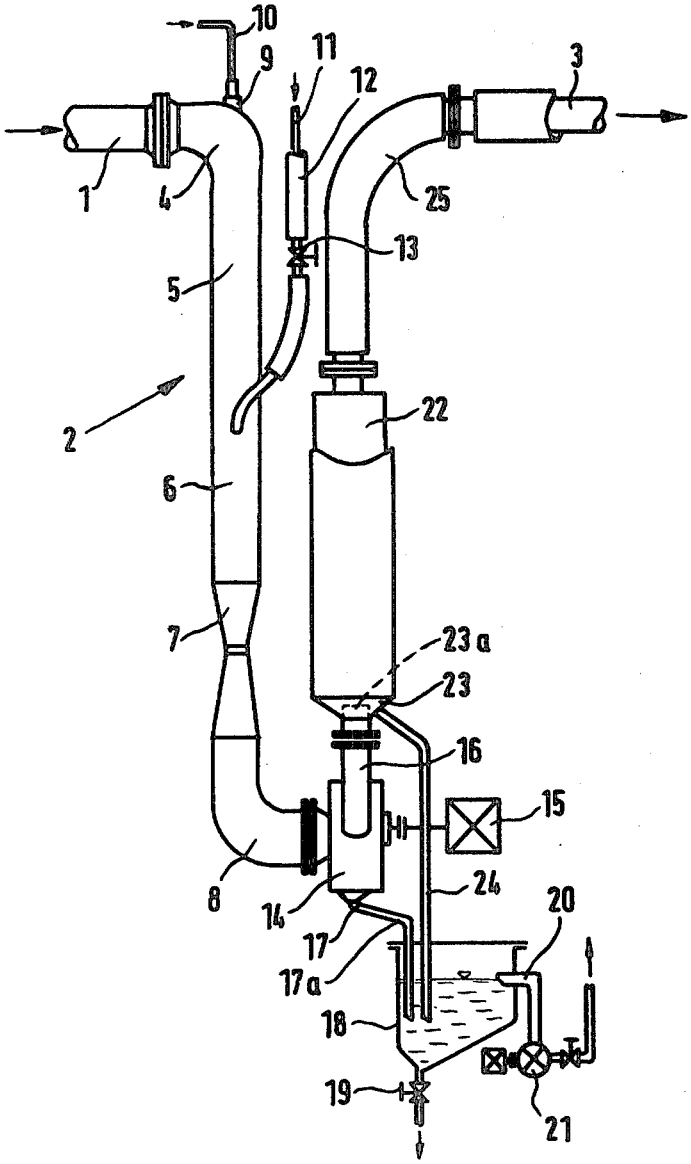
10
9
11
12
3
1
4
25
13
5
2
22
6
7
23a
23
16
15
8
14
24
20
17
17a
18
19
21

METHOD AND APPARATUS FOR PURIFYING GASES LEAKING FROM COKE OVENS

The invention relates to equipment for the extraction of tar-containing gases leaking from the oven door, having at least one extraction device located at a point of leakage, a collection duct connected thereto and an extractor fan located in the latter.

In coking plants, the oven chambers are tightly closed against the ambient air by means of oven doors; because of the considerable sizes of the construction, however, points of leakage are unavoidable, and tar-containing oven gas which must be extracted emerges from these points. For this purpose, extraction devices in the region of the door frames are known, which devices are fitted, for example as collection hoods, at a certain distance from the points of leakage, so that it is impossible here to avoid that, aditionally to the leakage gases, inleaked air is drawn in in a quantity many times that of the former. This inleaked air mixes with the leakage gases and cools these down, in particular in winter, so that the temperature of the discharged mixed gases within the collection duct, which is connected to the extraction devices of an oven door and which can have a length of several hundred meters, is lowered to such an extent that it falls below the pour point of tar. Admittedly, the point where the temperature falls below this value varies as a function of the temperature of the inleaked air which is drawn in and of the heat loss from the collection duct; the essential point is, however, that, starting at the said point, tar separates out which precipitates on the walls of the collection duct and on the downstream extractor fan so that the cross-section of the duct is diminished in the course of time by deposits and the efficiency of the extractor fan is appreciably impaired by deposits on the blade surfaces.

Since the tar-containing mixed gases can be conveyed without substantial problems up to the point mentioned above, where the temperature falls below the pour point of the tar, it would be desirable to displace this point up to the end of the collection duct by suitable measures. A measure for this purpose would, for example, be the introduction of superheated steam under a high pressure into the collection duct a short distance upstream of the point mentioned above, in order to reheat the cooled-down mixed gases and to prevent the temperature falling below the pour point or to maintain the mixed gases a priori at a temperature which, as far as possible, prevents the transition from the vapor state into the liquid state. Although, with good insulation, a single introduction of steam should suffice for avoiding deposits of tar or choking with tar, it can be necessary in the case of very long collection ducts, in which the temperature falls several times to the pour point of tar, to introduce superheated steam several times so that in the end the flow rate which has to be handled by the extractor fan is a multiple of the original flow of mixed gas so that the extractor fan would have to be oversized in a most uneconomical manner. Moreover, it can hardly be avoided that a vertical flow forms in the collection duct as a result of the introduction of superheated steam, and this vortical flow has the effect of causing any condensate droplets which may form to be thrown against the walls of the collection duct.

It would also be possible to introduce saturated steam a short distance upstream of the abovementioned point, which saturated steam condenses out within the collection duct so that, due to the vortical flow which is generated, a film of hot water is formed on all the walls of the collection duct, which film on the one hand heats the walls of the collection duct and thus prevents tar from condensing out and, on the other hand, heats any tar which may adhere to a temperature above its pour point and flushes it on to the end of the collection duct. If the ducts are very long, however, it is also necessary to carry out several introductions of saturated steam since, otherwise, increasingly thick rubber-like sticky layers form downstream.

Starting from this state of the problem, it is the object of the invention to develop the initially mentionedequipment for the extraction of tar-containing gases leaking from the oven door in such a way that the difficulties due to the deposition of tar are avoided.

According to the invention, the object is achieved when a device for gas purification is provided in the collection duct, by means of which at least a substantial part of the tar can be removed from the mixed gases. Thus, there is no attempt, as in the possibilities indicated above, to displace the point, where the temperature of the mixed gases falls below the pour point of the tar, out towards the end of the collection duct as far as possible, but instead, it is possible, for example, deliberately to accept the fall of the temperature below the pour point and to exploit it for purifying the gas by using, for purification of the gas, say a cyclone separator which has heated walls and in which the droplets of tar, which have formed when the temperature falls below the pour point, are thrown out against the walls of the cyclone by a centrifugal force and are there heated up above the pour point so that the tar can steadily flow off and can be withdrawn on the underside of the cyclone via a gas lock.

According to an embodiment of the invention, it is especially advantageous when the device for gas purification consists of an electrostatic filter in which the tar is deposited. A filter of this type has the great advantage that depositions and/or condensations of any type in the downstream ducts and units can be avoided and the leakage gases can thus be extracted trouble-free and without significant resistances in spite of a long extraction duct of perhaps several 100 meters.

In a further embodiment of the invention, a steam line is fitted on the collection duct upstream of the filter, and saturated steam can be jetted in continuously or in the case of need, in order to avoid explosions of the gas mixture due to sparking on the electrode. To avoid incrustations, the entire system is advantageously flushed for a certain time with crude ammonia liquor and saturated steam, before it is put into operation, in order to apply a thin protective film to all the components of the equipment in order to prevent a priori an adhesion of small particles of tar and/or solids as far as possible.

As explained above, the invention avoids the necessity for any expensive measures to displace the point, where the pour point temperature of the tar is reached, up to the end of the collection duct; rather, this point can advantageously be exploited for gas purification. In practice, however, there is the difficulty of exactly localizing this point from case to case if, as frequently applies, the collection duct is subject to a wide fluctuation of the temperature due to the time of day and the season. For this reason, a further, particularly advantageous embodiment of the invention proposes that the device for gas purification comprises an installation for spraying hot ammonia liquor into the collection duct and a separator located downstream thereof. Since it is not necessary that the tar present in the stream of mixed gas is washed out in the immediate vicinity of the point where the temperature falls below the pour point, the further development of the invention provides the designer of equipment according to the invention with greater freedom for arranging the device for gas purification; moreover, the ammonia liquor sprayed in serves both for heating the walls of the collection duct and for washing off any tar which may adhere and which is flushed out in the separator together with the ammonia liquor, so that it is not absolutely necessary to provide a spray mist of such density as would be necessary to wash out all the tar.

The last-mentioned illustrative embodiment is of particular advantage for the reason that ammonia liquor is anyway obtained in a coking plant as gas liquor from the condensation and is freed from impurities in a separator unit so that it is not necessary, when the device according to the invention is employed for gas purification, to provide a special separator vessel for foul water (ammonia liquor). Such ammonia liquor is pumped in a large quantity for scrubbing the foul gas main and spraying the valves in the off-take main, so that it is a simple matter to divert a relatively small part stream of this gas liquor, which is available under pressure, in the vicinity of the last point of use (valves in the off-take main) and to utilize it for washing the gases leaking from the door.

In principle, it is possible to provide the installation for spraying in hot ammonia liquor at any desired point of the collection duct; according to a further embodiment of the invention, however, it is of particular advantage to locate this installation at the junction of the collection duct to the extraction device, that is to say at a point where the problem, on which the invention is based, of fouling of the extraction unit by tar does not yet arise; it is thus possible to exploit the available temperature of the mixed gas which is to be purified for the scrubbing process and to achieve a particularly good purification result with the smallest possible energy consumption.

According to a further embodiment of the invention, a saturated steam line additionally leads into the collection duct between the installation for spraying in ammonia liquor and the separator; the steam serves on the one hand for assisting the scrubbing process and on the other hand for keeping warm the ammonia liquor and thee walls of the collection duct up to the separator, in order to achieve a particularly reliable resulting of scrubbing; it is here particularly advantageous to use saturated steam or steam of low wetness, which in turn condenses on the way to the separator so that the water condensed out can be removed in the separator together with the ammonia liquor which has been sprayed in and the tar; neither the steam nor the ammonia liquor thus increase the real throughput of the collection duct so that a significant enlargement in the design of the extractor fan also is not necessary.

In principle, it is an advantage to locate the extractor fan as far as possible downstream of the point where the temperature falls below the pour point of tar, in order to ensure that any tar which might not have been removed by the device for gas purification is precipitated on the walls of the collection duct before it reaches the fan and could foul the latter. According to a further embodiment of the invention, however, the extractor fan is designed as a separator (disintegrator) and is thus moved precisely into the zone in which the tar is removed from the mixed gas and in which the mixed gas is additionally also charged with steam and ammonia liquor. Although it would be entirely possible at this point for relatively large quantities of tar to impinge on blade surfaces of the fan, if the quantity of ammonia liquor is such that only a part of the tar is scrubbed out, the continuous heating by saturated steam or the continuous flushing with ammonia liquor on the blade surfaces ensures that any adhering tar is immediately removed and whirled off. The last-mentioned embodiment of the invention thus not only saves an additional separator which would induce a pressure drop, but in addition also keeps the extractor fan, which is subject to fouling, continuously clean so that it is not necessary to remove all the tar from the mixed gases by the device according to the invention for gas purification.

According to a further embodiment, it is even an advantage that, downstream of the extractor fan, the collection duct has a section of enlarged cross-section as an additional residual-spray separator. As a result of this neasure, the gas velocity is greatly reduced, and this results in a forced precipitation or condensation of the tar.

If the device according to the invention for gas purification does not remove almost all the tar from the mixed gases, it is advantageous according to a further embodiment of the invention that the collection duct is provided with heat insulation, downstream of the device for gas purification, in order to prevent condensing out within the collection duct.

The subject of the invention is explained in yet more detail by reference to the attached diagrammatic drawing.

In the drawing, equipment according to the invention for the extraction of tar-containing gases leaking from the oven door is shown; the connecting branch 1 of an extraction device (not shown) is flanged to a device 2 for gas purification, which in turn represents the first section of a collection duct; a second section 3 (only partially shown) leads to an off-take and has a length of 180 m in the selected example.

A mixed gas which consists of 20% of leakage gases and 80% of inleaked air and which can have a tar content of about 3% flows from the extraction device through the connecting branch 1. The throughput is about 1.4 $m^3$/second.

The first part of the purification device 2 which consists of an upper pipe elbow 4, a vertical section 5, 6, 7 and a lower pipe elbow 8 is flanged to the connecting branch 1. Ammonia liquor which is supplied from the scrubbing of the foul gas main of the coking plant via a water line 10 with a throughput of 5 $m^3$/hour is sprayed downwards into the upper pipe elbow 4 and into a device 9 arranged coaxially to the vertical section 5, 6, 7. The vertical section 5 forms a scrubbing zone in which the dense $NH_3$/water mist scrubs out the tar. A stream line 11 leads into the upper end of the section 6 which forms a main scrubbing zone; the steam line 11 is provided with insulation 12 and has a shut-off valve or control valve 13, by means of which wet steam under a pressure of 2.2 atmospheres and in a maximum throughput of 250 kg/hour can be introduced if required, in the base where the mixed gases had not already been sufficiently purified in the prescrubbing zone.

The underside of the main scrubbing zone is adjoined by the vertical section 7 which is designed as a venturi and which makes a better contact of tar constituents and steam or ammonia liquor possible and by means of which, moreover, a convenient measurement of pressure or throughput is possible. The lower pipe elbow 8 is connected to the underside of the vertical section 7. The connecting branch 1, the pipe elbows 4 and 8 and also the sections 5 and 6 all have the same internal diameter and together their lengths are approximately thirteen times their internal diameter.

The length of the vertical section 7 is five times the abovementioned diameter. If the mixed gases are introduced in the connecting branch 1 at a temperature of about 20 ° C. to 80 ° C., a mixture of largely purified mixed gases and tar-fouled water droplets or ammonia liquor droplets flows out at the lower pipe elbow 8.

The suction branch of a fan separator 14, which is driven by the motor 15, is flanged to the pipe elbow 8. The fan separator 14 has a gas outlet 16 and a liquid outlet 17 to which discharge pipe 17*a* is fitted, which leads into a collecting vessel 18. At its lowest point, the collecting vessel 18 has a drain valve 19 which normally closed and, at the height of its liquid level, an outflow 20, by means of which the height of the liquid level is simultaneously controlled continuously. The outflow 20 is connected to a motor-driven pump 21 which passes the liquid on from the collecting vessel for spraying into the extraction line for crude oven gas or into a receiver and passes it further from these parts to the tar separator vessel. The outside of the collecting vessel 18 is provided with a heat-insulating layer in order to avoid a deposition of tar sludge as far as possible.

The gas outlet 16 of the fan separator 14 has a slightly smaller cross-section than the lower pipe elbow 8, points upwards and leads into a vertically arranged residual-spray separator 22, the clear width of which is about twice that of the gas outlet 16; the residual-spray separator 22 extends in the vertical direction over a length which corresponds approximately to four times its diameter; the outside walls of the residual-spray separator 22 are provided with a heat-insulating layer. On the underside, the flange of the gas outlet 16 is joined to the wall section of the residual-spray separator 22 via a conically shaped extension connector 23, within which a pipe sleeve 23*a* is located concentrically to the latter; a sump which is connected by a discharge pipe 24 to the collecting vessel 18 can thus form on the internal underside of the extension connector between the wall of the latter and the pipe sleeve. The discharge pipes 24 and 17*a* each end below the level of the liquid in the collecting vessel 18.

Tar droplets which are carried over into the residual-spray separator 22 impinge on the walls and flow down on the latter into the extension connector 23, and the heat insulation of the walls prevents the temperature from reaching or falling below the pour point. The discharge pipes 17*a* and 24 can preferably also be provided with heat insulation in order to avoid blocking with tar.

A heat-insulated outlet pipe elbow 25 which is in turn connected to the second section 3 of the collection duct, is flanged to the top side of the residual-spray separator 22.

As can be seen from the drawing, the connecting branch 1 of the extraction device and the second section 3 of the collection duct are aligned in the horizontal direction.

It is, of course, intended to cover by the appended claims all such modifications as fall within the true spirit and scope of the invention.

What is claimed is:

1. Apparatus for treating the tar-containing gases leaking from the oven door of a coke oven by separating tar from the gases in a manner to avoid substantial plugging of the apparatus and to substantially reduce the probability of explosion comprising:

at least one gas extraction device located at the point of leakage of said gases;

an extractor fan and a collection duct connecting said extraction device with the extractor fan;

means for spraying hot ammonia liquor into the upstream portion of the collection duct; and means for introducing saturated steam into the collection duct downstream of said ammonia spraying means.

2. Apparatus in accordance with claim 1 further including means for removing the ammonia liquor downstream of said spraying means.

3. Apparatus in accordance with claim 2 in which said removing means further includes means for extracting condensed steam from said collection duct.

4. Apparatus in accordance with claim 1 including means associated with the collection duct for purifying the gases flowing therethrough.

5. Apparatus in accordance with claim 4 in which said means for purifying the gases includes an electrostatic filter.

6. A method for treating the tar-containing gases leaking from the oven door of a coke oven by separating tar from the gases in a manner to avoid substantial plugging of the apparatus and to substantially reduce the probability of explosion comprising the steps of:

sucking said gases through at least one extraction device located at the point of leakage and thereafter through a collection duct connected thereto and into an extractor fan;

spraying hot ammonia liquor into the gases within the upstream portion of the collection duct; and introducing saturated steam into said gases dispersed through the ammonia liquor spray.

7. The method set forth in claim 6 and further including the step of reducing the gas velocity in the collection duct to facilitate the forced precipitation or condensation of the tar.

8. The method as set forth in claim 7 including the step of maintaining the collection duct at a sufficiently high temperature to insure that any tar in the duct will pour.

* * * * *